United States Patent [19]

Armstrong

[11] Patent Number: 4,506,140

[45] Date of Patent: Mar. 19, 1985

[54] ELECTRIC IMMERSION HEATER ASSEMBLY HAVING AN ISOLATED TERMINAL BOX

[76] Inventor: Richard M. Armstrong, Box 566, West Chester, Pa. 19380

[21] Appl. No.: 441,483

[22] Filed: Nov. 15, 1982

[51] Int. Cl.[3] ..... H05B 3/82; F24H 1/00

[52] U.S. Cl. ..... 219/315; 219/306; 219/312; 219/316; 219/331; 219/336; 219/523; 219/537; 219/540

[58] Field of Search ..... 219/310, 312, 316, 318, 219/319, 320–322, 328, 331, 335–338, 523, 437, 315, 306, 537, 540, 530

[56] References Cited

U.S. PATENT DOCUMENTS

| | | | |
|---|---|---|---|
| 1,817,850 | 8/1931 | Schwalbach | 219/316 X |
| 1,985,831 | 12/1934 | Hynes | 219/315 X |
| 2,010,331 | 8/1935 | Starrick | 219/314 X |
| 2,213,464 | 9/1940 | Fogwell | 219/320 |
| 2,536,747 | 1/1951 | Hynes | 219/315 |
| 2,712,052 | 6/1955 | Buehne | 219/316 |
| 2,860,226 | 11/1958 | Williams et al. | 219/437 |
| 3,310,657 | 3/1967 | Samtoro | 219/325 X |
| 3,446,939 | 5/1969 | Morgan et al. | 219/316 |
| 3,446,940 | 5/1969 | Morgan | 219/318 |
| 3,458,948 | 8/1969 | Curtis et al. | 43/129 |
| 3,597,589 | 8/1971 | Morgan | 219/321 |
| 4,131,785 | 12/1978 | Shutt | 219/326 |
| 4,179,603 | 12/1979 | Zeigler et al. | 219/538 |
| 4,255,646 | 3/1981 | Dragoy et al. | 219/275 |
| 4,343,988 | 8/1982 | Roller et al. | 219/302 |

FOREIGN PATENT DOCUMENTS

| | | | |
|---|---|---|---|
| 1014728 | 8/1957 | Fed. Rep. of Germany | 219/318 |
| 857365 | 12/1960 | United Kingdom | 219/318 |

*Primary Examiner*—A. Bartis

*Attorney, Agent, or Firm*—Kenneth P. Synnestvedt

[57] ABSTRACT

An electric heater adapted to be extended through an aperture in a tank wall for immersion in a fluid to be heated includes an elongated heater block structure formed by a metal core cast in a tubular metal shell. The core has a plurality of axially extending cavities, each removably receiving an individual elongated electric heating element having a terminal end extending from an open end of the cavity. An end plate secured to the shell of the heater provides a radially projecting flange for use in connecting the heater to the tank. The terminal end of each heating element projects through the end plate and the wall of a terminal box. Packing devices are provided around the heating elements to seal apertures in the end plate and terminal box wall through which the heating elements extend. The terminal box is spaced from the end plate to isolate the box from the heater block and the tank in order to minimize the possibility of leakage of liquid into the box. The heater further includes a temperature responsive device positioned in an elongated cavity in the core and extending through the end plate to a control unit regulating the current supply to the heating elements. A plurality of axially extending perforated fins may be provided on the external surface of the shell for enhancing heat transfer to the fluid to be heated. A tubular sleeve connected at one end to the end plate may be provided in spaced relation to the shell to define a tubular chamber surrounding the heater for axial flow of the fluid to be heated.

12 Claims, 11 Drawing Figures

TEMP CONTROLLER
THERMOCOUPLE
ELECTRIC HEATER ELEMENT

ELECTRIC IMMERSION HEATER ASSEMBLY HAVING AN ISOLATED TERMINAL BOX

BACKGROUND AND STATEMENT OF OBJECTS

Heaters for use in heating various fluids including liquids and gases in tanks have been known and have been constructed in a variety of different ways. In one form of such heaters, the heater comprises an elongated shell, for instance a cylindrical shell, in which is cast a block of a heat conductive metal, such as aluminum. A plurality of tubes are positioned within the cast metal, being closed at one end and being opened externally of the metal block at the other end. Individual electrical heater elements are positioned in each tube within the block, and provision is made for withdrawing and replacing individual heater elements from the open ends of the heater tubes.

In the present application a heater of the general kind just referred to is sometimes identified as a "block" type heater.

In the arrangement provided by the present invention, the metal of the heater block is cast within a shell, for instance a cylindrical tube, which is closed at one end but which is open at the other end adjacent to the open ends of the tubes for receiving the individual heater elements. An end plate for the heater is provided, being integrally connected, as by welding to the shell of the heater, the end plate having a radially projecting flange adapted for use in the connection of the heater with a tank or other receptacle in which the heater is to be positioned.

According to the present invention, an electrical junction box is provided, being arranged so that the individual heater elements can be removed and replaced, and connected and disconnected to the appropriate power circuit. According to the present invention, this junction box is separated or isolated from the remainder of the heater, including the end plate above referred to; and the end plate is provided with apertures through which the individual heater elements extend, so as to bridge the space between the heater itself and the junction box and project into the junction box.

Packing devices are associated with the heater elements where the elements project through the end plate of the heater itself and also through the adjacent but spaced wall of the junction box, thereby providing for isolation of the junction box from the body of the heater and from the tank or fluid containing structure with which the heater is employed.

The invention, therefore, provides for effective isolation of the junction box from the heater itself while, at the same time, permitting ready withdrawal and replacement of individual heater elements. Indeed, as will appear more fully hereinafter, this ready withdrawal and replacement of heater elements is made possible without hazard of any appreciable contact with the liquid or other fluid being heated, even in the event of accidental leakage of the liquid from the tank into the interior of the heater shell.

The isolation of the junction box from the heater and from the tank or container in which the fluid is contained is of particular importance in connection with equipment used for the heating of a wide variety of liquids, such as oils, viscous materials, such as molasses, or various other liquids or gases having explosive or contaminating characteristics.

In addition to the foregoing, the invention contemplates employment of heat transfer fins on the outside surface of the shell in which the heater block is cast. According to the invention, these fins are extended longitudinally of the shell and may comprise either imperforate or perforated fin elements according to certain particular installations, as will be explained more fully hereinafter. Indeed, for certain purposes the heater of the present invention may even be effectively used without heat transfer fins.

BRIEF DESCRIPTION OF THE DRAWINGS

How the foregoing objects and advantages are attained will appear more fully from the following description referring to the accompanying drawings.

In the drawings, two embodiments are illustrated, one being shown in FIGS. 1 to 6 inclusive, and the other being shown in FIGS. 7 to 10 inclusive. Most components of the heater shown in these two embodiments are the same, but the two embodiments illustrate alternative ways for installation and use of the heater of the invention, as will be explained more fully hereinafter.

In the first embodiment of the drawings:

FIG. 1 is a sectional view of a portion of a tank with the heater of the present invention applied thereto, certain portions of the heater structure being shown in section;

FIG. 2 is an elevational view from the left end of FIG. 1, taken as indicated by the line 2—2 applied to FIG. 1;

FIG. 3 is a view taken as indicated by the line 3—3 on FIG. 1;

FIG. 4 is an enlarged view taken as indicated by the line 4—4 on FIG. 1;

FIG. 5 is an enlarged transverse sectional view through the heater itself, taken as indicated by the section line 3—3 on FIG. 1; and FIG. 6 is a fragmentary sectional view taken as indicated by the section line 6—6 on FIG. 4.

In the second embodiment of the drawings:

FIG. 7 is a view similar to FIG. 1 but illustrating the utlization of the heater of the present invention in association with a receptable for the fluid to be heated of a different type than shown in FIG. 1;

FIG. 8 is an enlarged view taken as indicated by the line 8—8 on FIG. 7;

FIG. 9 is an enlarged transverse sectional view through the heater itself, taken as indicated by the section line 9—9 on FIG. 7; and FIG. 10 is a fragmentary sectional view taken as indicated by the section line 10—10 on FIG. 8.

FIG. 11, is an enlarged detail sectional view of a packing device which may be used for the heater elements of either of the two embodiments above referred to.

DETAILED DESCRIPTION OF THE DRAWINGS

In the embodiment of FIGS. 1 to 6 inclusive, the heater of the invention is shown as installed in a tank having walls such as indicated at 11 defining a chamber for a fluid to be heated, usually a liquid. The tank wall is provided with an opening having a tubular connection 12 associated therewith through which the heater may be inserted and removed from the tank. The heater itself comprises a shell 13 in which a core or "block" 14 is cast. This casting is preferably formed of a metal having good thermal conductivity, for instance aluminum. The block is desirably cast with a central tube 15 extended through the central part of the block, the tube 15 having its inner end abutting the end wall 13*a* of the shell 13, so that the cast block is of cylindrical shape throughout its length.

Figure 6:
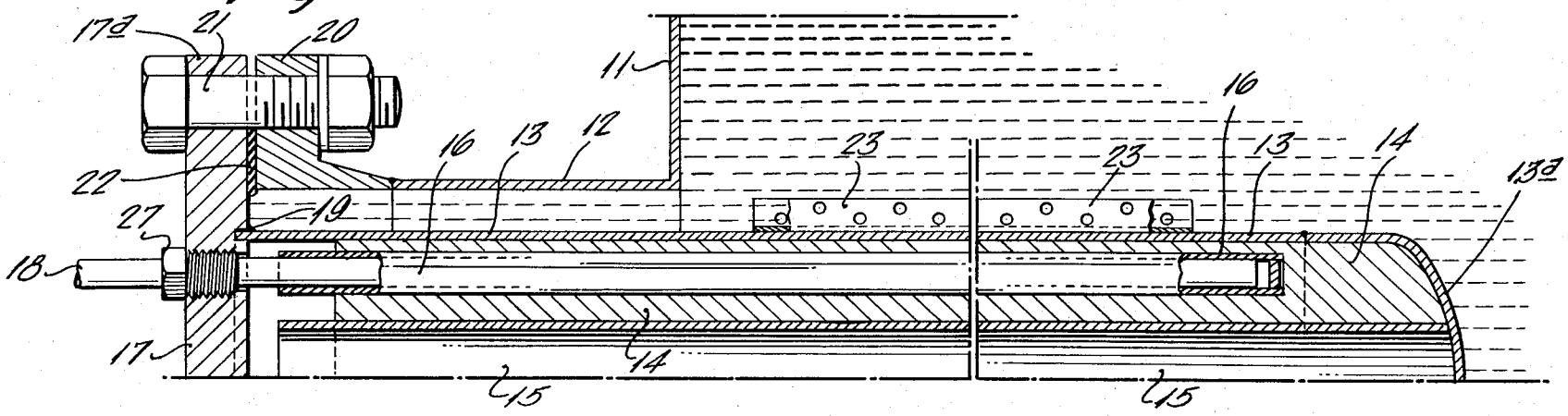

For the purpose of accommodating the desired electrical heating elements, a plurality of metal tubes 16 are desirably positioned within the cylindrical block 14 and extend through most of the length of the block, but are terminated short of the inner end, as clearly appears in FIG. 6. These tubes are preferably made of precision tubing and are preferably cast in the block 14.

Figure 1:
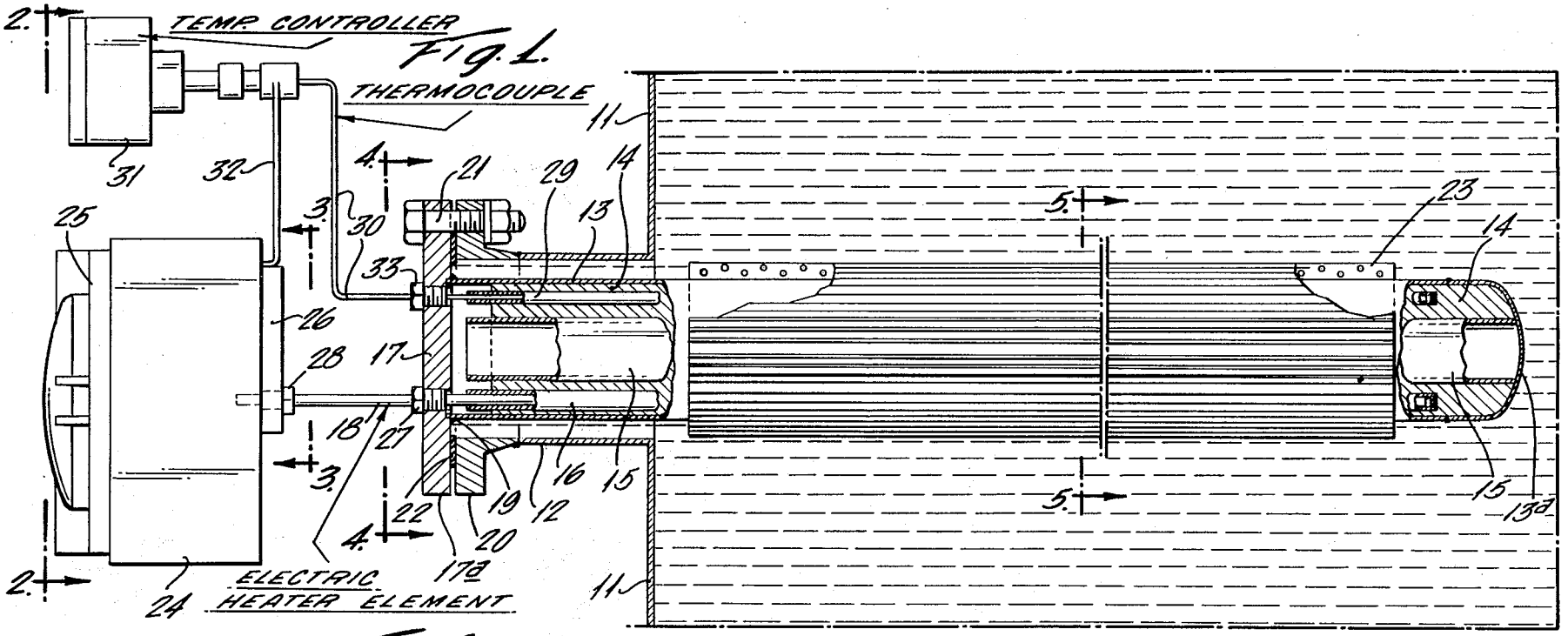

An end plate 17 for the heater assembly is provided as a closure for the open end of the shell 13, as appears toward the left in FIGS. 1 and 6.

This end plate is provided with apertures aligned with the tubes 16 through which heater elements indicated at 18 may extend. The end plate is preferably welded to the shell 13, as indicated at 19, and the end plate is also provided with a portion 17*a* peripherally extending beyond the shell 13 and cooperating with a flange 20 formed on the tubular connection 12 associated with the tank 11, the adjacent portions 17*a* and 20 being bolted together as indicated at 21 with a sealing gasket 22 therebetween.

Figure 5:
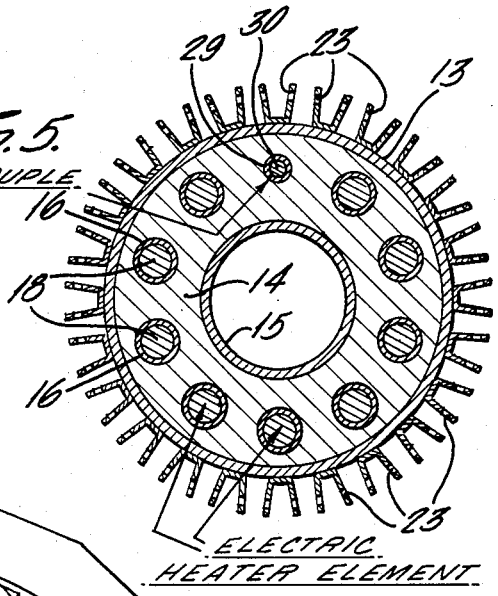
Figure 4:
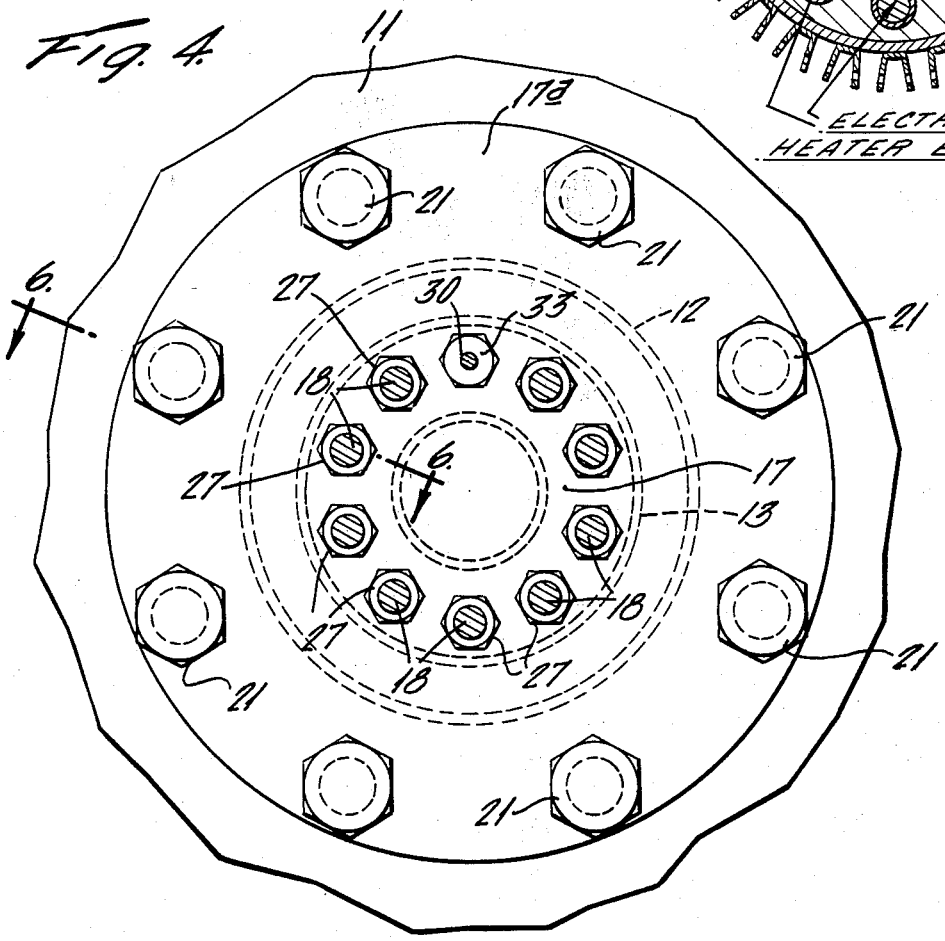

For many installations, the shell 13 of the heater is desirably provided with heat exchange elements, such as the fins indicated at 23. It will be seen that these fins extend longitudinally of the heater and are perforated or apertured as shown in FIGS. 1 and 6, thereby providing for flow of the fluid being heated through the perforations and thereby increase the heat transfer between the shell of the heater and the liquid in the tank. The heat exchange fins are advantageously distributed around the circumference of the heater, for instance as indicated in FIG. 5. This perforated type of fins are particularly effective for installations in which circulation of the fluid being heated occurs under the influence of natural convection currents. Such perforate fins are advantageously used in units adapted for heating liquids or gases. An embodiment using imperforate fins is described hereinafter.

Figure 2:
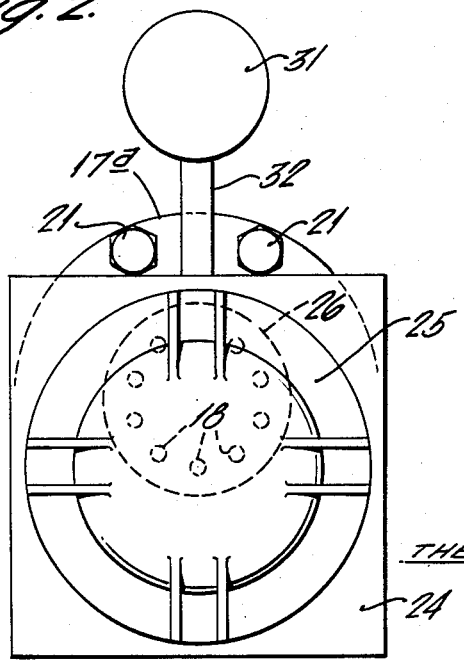
Figure 3:
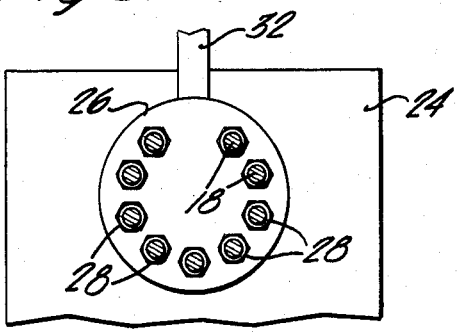

A terminal or junction box for the heater elements is indicated at 24 in FIGS. 1, 2 and 3, the junction box being spaced from the end plate 17, as clearly appears in FIG. 1. The heater elements 18 extend from the apertures in the end plate 17 through the space between the plate 17 and the junction box; and the heater elements also extend into the junction box, as will be understood, for the purpose of establishing the desired electrical connections for the heating current and also for controls. The junction box is provided with a door or closure 25 on its outer side (the left side as viewed in FIG. 1) in order to provide access to the terminal components within the box and also in order to permit withdrawal of any individual heater element 18 from the heater and also for the return of a heater element into the heater itself. Preferably, the wall 26 through which the heater elements 18 extend into the junction box (see FIGS. 1 and 3) is provided with individual apertures for the several heater elements 18. In addition, packing devices 27 are provided for the heater elements where they extend through the apertures in the end plate 17. Preferably also, packing devices 28 are provided where the heater elements pass through the wall 26 into the junction box 24.

With regard to the heater elements 18, it is to be understood that these devices include appropriate electrical resistance elements and may be constructed in a variety of different way, Several forms of such heater elements or devices are available, in view of which the details of construction of the elements themselves need not be considered herein. It is pointed out, however, that heater elements suitable for the purposes of the present invention have an external substantially cylindrical shape. The elements used preferably substantially fill the cylindrical space within the tubes 16, but may readily be withdrawn or inserted. The substantially cylindrical external shape of the elements is also desirable from the standpoint of providing for effective packing by means of the devices 27 and 28.

Figure 11:
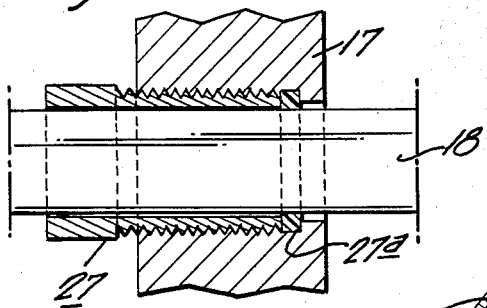

The sectional view of FIG. 11 shows one form of packing device preferably used according to this invention. The device 27 here shown has very small clearance around the heater element 18, for instance clearance of from about 0.0015" to 0.008", measured as the difference between the external diameter of the heater element and the internal diamter of the packing device. Clearance in the range indicated is effective not only to block various liquids but even to substantially block various gases. If still tighter sealing is desired a resilient gasket may be inserted, as indicated at 27*a* in FIG. 11 but for many purposes this is not needed. With the gasket the packing may even be made watertight.

Packing devices of the kinds above referred to are preferably used not only where the heater elements pass through the end plate 17 but also where the heater elements pass through the terminal box wall 26.

The packing devices 27 are of importance as a safeguarding feature which prevents flow of fluid along the heater elements toward the junction box, in the event of leakage of the fluid being heated into the region of the open end of the heater block 14. Similarly, the packing devices 28 surrounding the heater elements 18 at the point of entrance into the junction box also represents a safety feature operative in the event of leakage, in order to virtually eliminate any possibility of entrance of the liquid being heated into the junction box.

Desirably, the core or block 14 is provided with still another internal tube indicated at 29 for receiving a thermostat or a thermocouple element 30 associated with the thermocouple control unit 31 which, in turn, would have appropriate connections (not shown) with the power supply to the terminal box 24. The unit 31 may be supported on the terminal box as indicated at 32. A packing device 33, which may be of the type described above, is also associated with the element 30 where the element 30 passes through the end plate 17. By employment of the single thermocouple lying within the tube 29 extended into the block of the heater, a single temperature control system may be employed in connection with the entire group of electrical heating elements 18. Since the heating elements all lie within the heater block itself, in relatively close association with each other, and since the heater block is composed of a metal having a high conductivity, the single control system for the group of heaters is effective for temperature regulation, particularly avoidance of excessive increase in temperature.

The actual terminal connections of the heater elements and the associated thermocouple form no part of the present invention per se and are, therefore, not illustrated and described in detail herein.

In accordance with the foregoing, a high degree of isolation of the fluid being heated in relation to the heater elements and the junction box as a whole is effectively provided by the arrangement of the end plate 17 in association with the heater block, including the surrounding shell 13 which is welded to the end plate. These features, together with the packing devices 27 and 33 associated with the end plate 17, and also the packing devices 28 associated with the junction box, provide safety and isolation even where flammable liquids or even gases are being heated and even in the event of liquid or gas leakage from the tank.

The heater of the present invention may alternatively be used without any heat exchange fins, for instance, for vaporizing various chemical compounds. Even under conditions where the heater is not completely immersed in the fluid being heated, the presence of both the heater elements 18 and the control element 30 in precision tubes within the heater block 14 provides for protection of the heater elements against undesirable overheating.

Various of the features above referred to including the presence of both the heating elements and the control element in the heater block, the use of cast metal block in a conductive shell having longitudinally extended fins, and also the isolation of the terminal box and the use of the packing devices, all contribute to exceptional versatility, adapting the heater of the invention to various uses already mentioned and also others described herebelow with reference to FIGS. 7 to 10.

Turning now to the embodiment shown in FIGS. 7 to 10 inclusive, it is first pointed out that the structure and arrangement of the principal components of the heater itself are the same as described above in connection with FIGS. 1 to 6. However, in FIGS. 7 to 10, the heater is shown in a different application. It is shown as applied to what is sometimes referred to as a "suction" type of heater.

For the type of installation shown in FIGS. 7 to 10, the heater is positioned within a suction tube indicated at 34. This tube 34 extends into a tank fragmentarily indicated at 35 through a tubular connection 36. The tubular connection 36 has a peripheral flange 37 associated with the annular flange 38 provided exteriorly of the tube 34. These parts are connected by means of bolts 39, with a sealing gasket 40 positioned between the flanges 37 and 38.

Figures 7, 10:
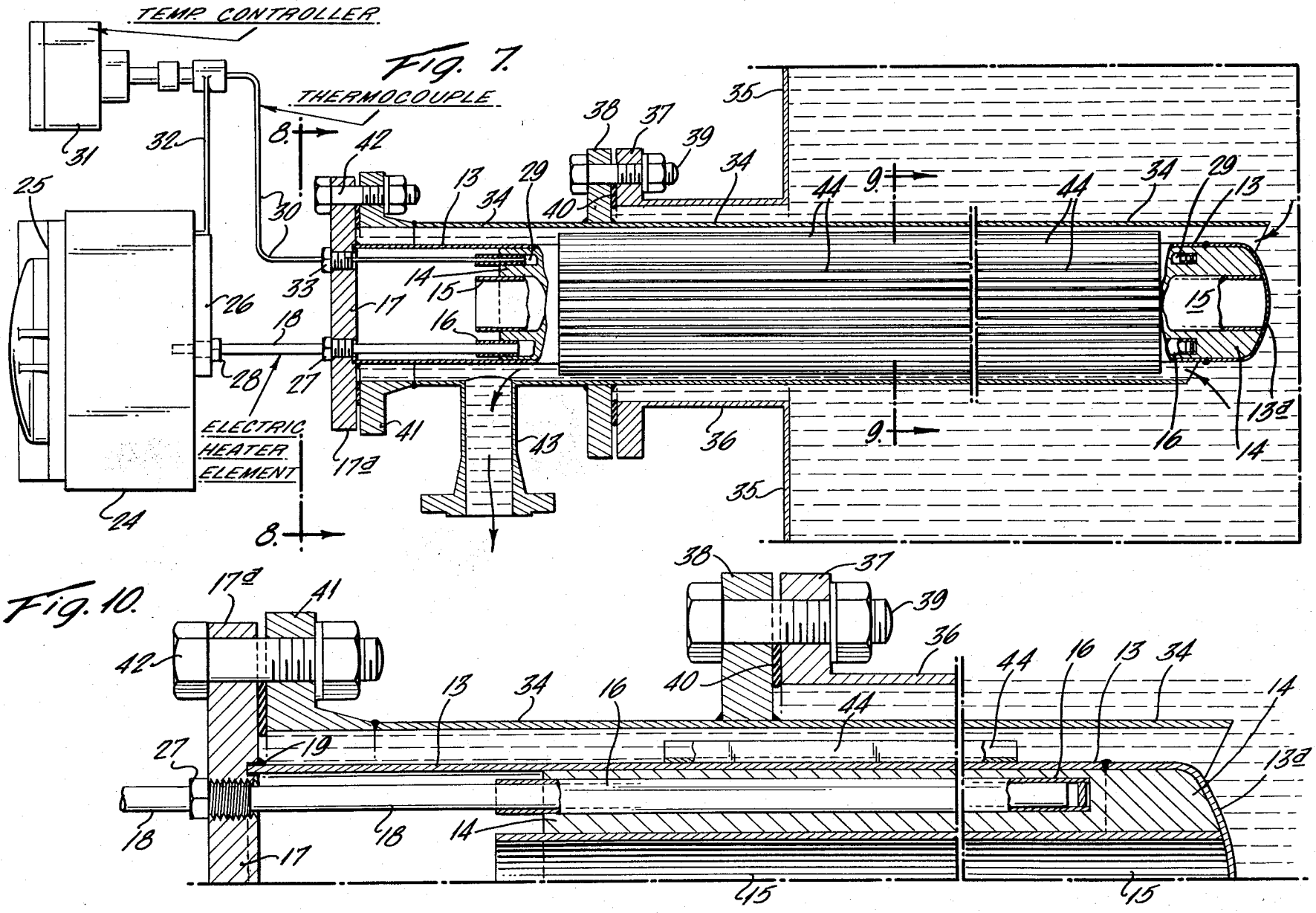
Figure 8:
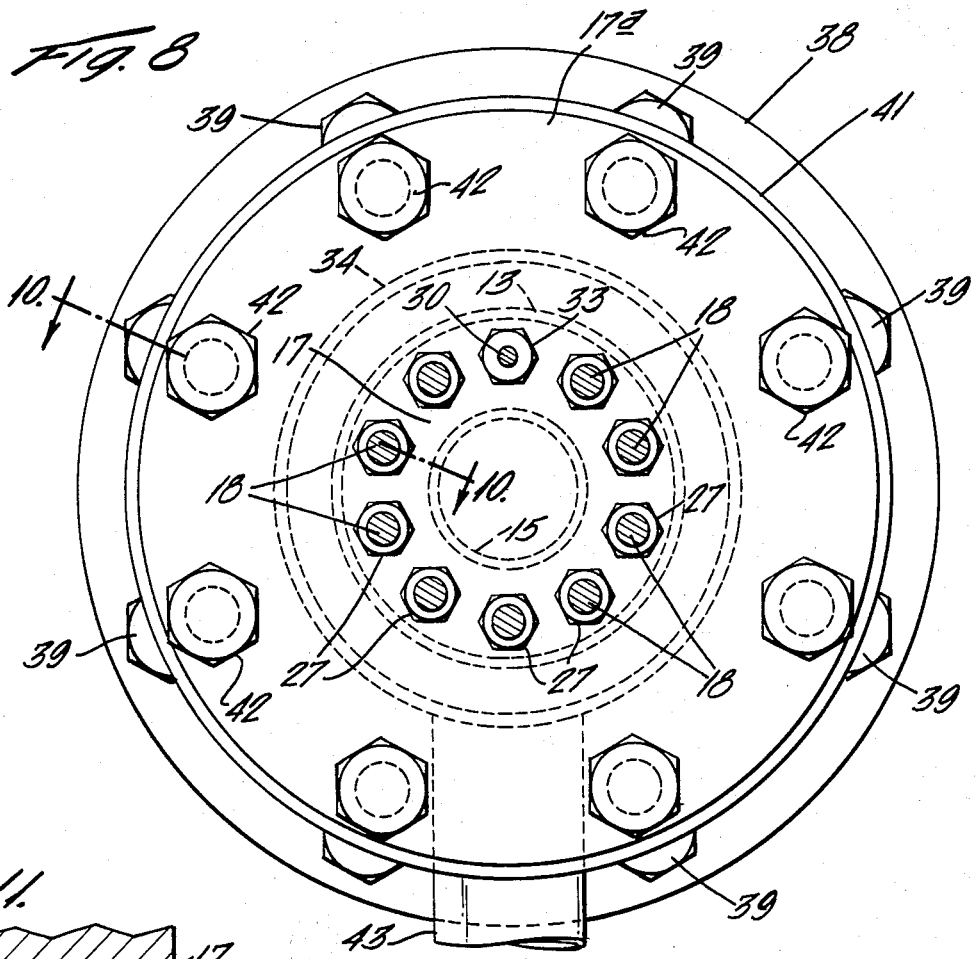

At its left end, as viewed in FIGS. 7 and 10, the suction tube 34 is provided with a peripheral flange 41 which is connected by means of bolts 42 with the peripherally extending portion 17*a* provided on the end plate 17 of the heater itself.

Figure 9:
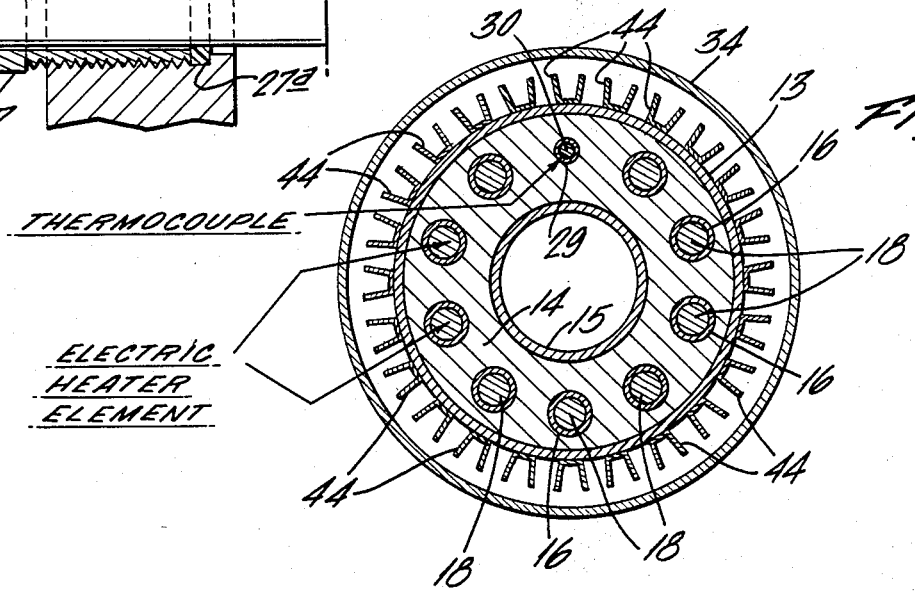

As will be seen particularly in FIGS. 7, 9 and 10, the suction tube 34 surrounds the shell 13 of the heater and is provided with a connection 43 which may be extended to a suction pump (not shown). The inner end of the suction tube 34 is open to the interior of the tank, as indicated toward the right in FIGS. 7 and 10; and in this particular application of the heater, it is contemplated that the suction pump to which the connection 43 is extended will have a return connection to the body of the liquid in the tank 35, in view of which the circulation system effects longitudinal flow of the liquid in the tank into the inner open end of the tube, along the outside of the heater shell 13 and thence into the suction connection 43 for recirculation through the pump. In this type of installation, it is preferred to employ heat exchange fins 44 extended along the outside of the heater shell 13. These fins preferably are imperforate, in contrast to the perforated fins employed in the type of installation illustrated in the first embodiment above described.

In the embodiment shown in FIGS. 7 to 10, the various parts of the heater core or block, the heating elements themselves, the terminal box, the packing devices, the thermocouple system and various related components may all be of the same construction as described above in connection with the first embodiment.

The same advantages, as referred to above, also result from use of the improved heater arrangement of the present invention in the kind of installation shown in FIGS. 7 to 10, as in the first embodiment. It will be understood that the equipment of the invention may also be employed in various other installations; and in all cases, the safety features are achieved while, at the same time, providing maximum facility for individual withdrawal and replacement of individual heater elements.

I claim:

1. An electric heater for use with a receptacle having walls defining a chamber for a fluid to be heated, the heater comprising an elongated heat conductive body adapted to be extended through an aperture in the receptacle wall and be immersed in the fluid to be heated and having a plurality of elongated cavities therein with axes spaced from each other and paralleling the axis of the elongated body, each of said cavities being open at one end of the body and being closed toward the other end thereof, a removable electrical heating element in each of said cavities, each element having a terminal end extended from the open end of the cavity, an end plate mounted on the conductive body adjacent the open ends of the cavities and with a radially projecting portion beyond the body of the heater and having perforations aligned with the open ends of the cavities, the terminal ends of the heating elements being extended through said perforations, packing devices sealing the perforations around the extended terminal ends, a terminal box for the extended terminal ends of the heating elements, the terminal box being spaced from said end plate and the terminal ends being extended through the space between the end plate and the terminal box and being extended into the terminal box, and means for connecting the radially projecting portion of the end plate with the portion of the receptacle walls surrounding the aperture through which the conductive body of the heater is adapted to extend.

2. An electric heater as defined in claim 1 and further including a temperature responsive control device positioned in an elongated cavity in the conductive body and having a terminal end extended through and packed in a perforation in the end plate, and control means connected with the terminal end of the control device and having means for controlling the current supply to the terminal ends of the heating elements.

3. An electric heater as defined in claim 1 and further including packing devices around the terminal ends of the heating elements extended into the terminal box.

4. An electric heater as defined in claim 1, in which the conductive body is provided with externally projecting heat exchange fins adapted to be exposed to the fluid to be heated.

5. An electric heater as defined in claim 1, in which the conductive body comprises a tubular metal shell with a metal core cast in the shell and in which the cavities in the body for receiving the electrical heating elements are formed in the cast metal core.

6. Equipment for use in heating a liquid, comprising a tank having walls defining a chamber for receiving the liquid to be heated, a tank wall being apertured below the level of the liquid in the chamber, electric heater equipment including an elongated heat conductive body extended into said chamber through the wall aperture, the heat conductive body having a plurality of elongated cavities therein with axes spaced from each other, each cavity being closed at its inner end and being open at its outer end externally of the tank wall, a removable electrical heating element in each of said cavities, each element having a terminal end extended from the open end of the cavity, an end plate mounted on the conductive body adjacent the open ends of the cavities and with a radially projecting portion beyond the body of the heater and having perforations aligned with the open ends of the cavities, the terminal ends of the heating elements being extended through said perforations, packing devices sealing the perforations around the extended terminal ends, means for connecting the radially projecting portion of the end plate to the tank wall around said aperture externally thereof, and a terminal box for the extended terminal ends of the heating elements, the terminal box being spaced from said end plate and the terminal ends being extended through the space between the end plate and the terminal box and being extended into the terminal box.

7. Equipment as defined in claim 6, in which the means for connecting the radially projecting portion of the end plate to the tank wall comprises a flange on the tank wall surrounding the aperture and mating with said radially projecting portion of the end plate.

8. Equipment as defined in claim 6, in which the means for connecting the radially projecting portion of the end plate to the tank wall comprises a shell surrounding the conductive body in spaced relation to the body, the inner end of said shell being open to the liquid chamber within the tank and the shell having a liquid circulation opening located externally of the tank, the outer end of said shell being connected with said end plate, and means connecting the shell to the tank wall around said aperture.

9. An electric heater for use with a receptacle having walls defining a chamber for a fluid to be heated, the heater comprising an elongated heat conductive body adapted to be extended through an aperture in the receptacle wall and be immersed in the fluid to be heated, the heat conductive body comprising a tubular shell and a cast metal core therein, having a plurality of elongated cavities therein with axes spaced from each other and paralleling the axis of the elongated body, each of said cavities being open at one end of the body and being closed toward the other end thereof, a removable electrical heating element in each of said cavities, each element having a terminal end extended from the open end of the cavity, an end plate mounted on the conductive body adjacent the open ends of the cavities and with a radially projecting portion beyond the body of the heater and having perforations aligned with the open ends of the cavities, the terminal ends of the heating elements being extended through said perforations, packing devices sealing the perforations around the extended terminal ends, the adjacent end of the tubular shell of the heat conductive body being sealed against the inside surface of the end plate, a terminal box for the extended terminal ends of the heating elements, the terminal box being spaced from said end plate and the terminal ends being extended through the space between the end plate and the terminal box and being extended into the terminal box, and means for connecting the radially projecting portion of the end plate with the portion of the receptacle walls surrounding the aperture through which the conductive body of the heater is adapted to extend.

10. An electric heater for use with a receptacle having walls defining a chamber for a fluid to be heated, the heater comprising an elongated heat conductive body adapted to be immersed in the fluid to be heated, the heat conductive body comprising a tubular metal shell and a cast metal core therein, having a plurality of elongated cavities therein with axes spaced from each other and paralleling the axis of the elongated body, each of said cavities being open at one end of the body and being closed toward the other end thereof, a removable electrical heating element in each of said cavities, each element having a terminal end extended from the open end of the cavity, an end plate mounted on the conductive body adjacent the open ends of the cavities and with a radially projecting portion beyond the body of the heater and having perforations aligned with the open ends of the cavities, the terminal ends of the heating elements being extended through said perforations, packing devices sealing the perforations around the extended terminal ends, the adjacent end of the tubular shell of the heat conductive body being sealed against the inside surface of the end plate, fins for effecting heat transfer from the shell of the elongated heat conductive body to the fluid to be heated, said fins comprising metallic strips extended lengthwise of and secured to the outside surface of the shell, and means for connecting the radially projecting portion of the end plate with the portion of the receptacle walls surrounding the aperture through which the conductive body of the heater is adapted to extend.

11. An electric heater as defined in claim 9 in which the fins are perforated.

12. An electric heater for use in heating a fluid, the heater comprising an elongated heat conductive body, the heat conductive body comprising a tubular metal shell and a cast metal core therein, having a plurality of elongated cavities therein with axes spaced from each other and paralleling the axis of the elongated body, each of said cavities being open at one end of the body and being closed toward the other end thereof, a removable electrical heating element in each of said cavities, each element having a terminal end extended from the open end of the cavity, an end plate mounted on the conductive body adjacent the open ends of the cavities and with a radially projecting portion beyond the body of the heater and having perforations aligned with the open ends of the cavities, the terminal ends of the heating elements being extended through said perforations, packing devices sealing the perforations around the extended terminal ends, the adjacent end of the tubular shell of the heat conductive body being sealed against the inside surface of the end plate, a tubular sleeve surrounding the body of the heater in spaced relation to the shell of the heater and defining a tubular chamber surrounding the heater for axial flow of the fluid to be heated, fins for effecting heat transfer from the shell of the elongated heat conductive body to the fluid to be heated, said fins comprising metallic strips extended lengthwise of and secured to the outside surface of the shell, and means for connecting the radially projecting portion of the end plate with the tubular sleeve surrounding the body of the heater.

* * * * *